US006085710A

United States Patent [19]

Uchiyama et al.

[11] Patent Number: 6,085,710

[45] Date of Patent: Jul. 11, 2000

[54] HEAT SHIELDING STRUCTURE FOR INTERNAL-COMBUSTION ENGINES

[75] Inventors: Takehito Uchiyama; Yoshinao Kobayashi, both of Yokkaichi, Japan

[73] Assignee: Sumitomo Wiring Systems, Ltd, Yokkaichi, Japan

[21] Appl. No.: 09/268,640

[22] Filed: Mar. 16, 1999

[30] Foreign Application Priority Data

Mar. 17, 1998 [JP] Japan ..... 10-066975

[51] Int. Cl.[7] ..... H01R 33/00

[52] U.S. Cl. ..... 123/169 PH; 439/126

[58] Field of Search ..... 123/169 PH, 169 PA; 439/125, 126, 128

[56] References Cited

U.S. PATENT DOCUMENTS

| | | | |
|---|---|---|---|
| 2,150,723 | 3/1939 | Nowosielski . | |
| 2,468,226 | 4/1949 | Murphy | 439/127 |
| 4,163,597 | 8/1979 | Brenholts | 439/126 |
| 4,497,532 | 2/1985 | Bezusko et al. | 439/485 |
| 4,671,586 | 6/1987 | Debolt | 439/126 |
| 5,026,294 | 6/1991 | Hisatomi et al. | 439/125 |
| 5,163,838 | 11/1992 | Tura, Jr. et al. | 439/126 |
| 5,348,486 | 9/1994 | Tura, Jr. et al. | 439/125 |
| 5,716,223 | 2/1998 | Phillips, Jr. et al. | 439/125 |

*Primary Examiner*—Henry C. Yuen
*Assistant Examiner*—Hieu T. Vo
*Attorney, Agent, or Firm*—Greenblum & Bernstein, P.L.C.

[57] ABSTRACT

A plug boot contains an ignition cable which is fitted with the stud terminal of a spark plug extending from an engine cylinder block. This plug boot is covered with a heat shield, and further with an auxiliary heat shield. The cylinder-side end portion of the auxiliary heat shield is fixed between the spark plug and the cylinder block. The cable-side end portion of the auxiliary heat shield is provided with a lid unit. This lid unit includes a fixing retaining member and a pressing portion. The fixing retaining member fits the lid unit to the auxiliary heat shield, while the pressing portion exerts downward forces on the plug boot. By the combination of fitting forces and downward forces, the ignition cable and the spark plug are reliably connected.

20 Claims, 14 Drawing Sheets

HEAT SHIELDING STRUCTURE FOR INTERNAL-COMBUSTION ENGINES

BACKGROUND OF THE INVENTION

1. Field of the Invention

The present invention relates to a heat-shielding structure for use in electrical connector assemblies, e.g. for connecting a spark plug to an ignition cable in vehicle internal-combustion engines, such as used in automobiles. The invention more particularly concerns structures that ensure heat-shielding for such connector assemblies, while maintaining reliable connections between the spark plug and the ignition cable.

2. Description of Background Information

Heat-shield structures for such connector assemblies are already known, for example, U.S. Pat. Nos. 4,671,586 and 5,163,838.

FIGS. 1 and 2 show a known connector assembly, in which a plug boot 510 houses a high-voltage terminal (not shown in the figure) at the end portion of an ignition cable K. The plug boot 510 is then fitted to a stud terminal Pt of spark plug P, which projects from a cylinder block head H of the internal-combustion engine. In this manner, the ignition cable K is normally connected to the spark plug P.

The plug boot 510 may be covered with a heat-shielding sheath 520 made of metal. The heat-shielding sheath 520 shields the radiant heat produced by heat-generating sources such as an exhaust manifold, so as to protect the plug boot 510 from heat deterioration.

An end portion of heat-shielding sheath 520 is provided with a downwardly-projecting spring 530 (shown in FIG. 1). When the plug boot 510 is fixed to the stud terminal Pt of the spark plug P, the spring 530 is placed into contact with a grounded portion of the spark plug P, so that heat-shielding sheath 520 is also grounded. Accordingly, electrical discharges normally generated from heat-shielding sheath 520 can be prevented.

However, the heat-shielding assembly shown in FIGS. 1 and 2 usually does not provide a sufficient heat-shielding effect. For instance, when a heat source is located adjacent to cylinder block head H, or the heat source becomes very hot, the plug boot 510 cannot be efficiently protected from heat deterioration.

According to another known type of heat-shielding assembly, shown in FIGS. 3 and 4, the heat-shielding sheath 520 is further covered with an auxiliary heat-shielding sheath 540.

The auxiliary heat-shielding sheath 540 has a generally cylindrical shape which is closed at one end to form a base. The base includes a hole 540*a*, through which a spark plug P and a threaded portion Pa pass. After threaded portion Pa passes through the hole 540*a*, the spark plug P is screw-mounted into a cylinder block head H. In this state, the peripheral zone of the hole 540*a* is flanked by the spark plug P and the cylinder block head H, and fixed between these two parts. Thereafter, auxiliary heat-shielding sheath 540 covers the outer surface of heat-shielding sheath 520 at a predetermined distance from the auxiliary heat-shielding sheath 540.

In the above-described assembly, the plug boot 510 is covered with a heat-shielding sheath 520. Therefore, the load applied by the plug boot 510 and the heat-shielding sheath 520 is directly applied to the fitting zone of spark plug P. When the internal-combustion engine vibrates in such a state, both the high-voltage terminal press-fitted to the end portion of ignition cable K within the plug boot 510 and the stud terminal Pt of spark plug P which is connected to the high-voltage terminal suffer from wear. Consequently, the plug boot 510 can become detached from spark plug P, and the internal-combustion engine may malfunction.

SUMMARY OF THE INVENTION

The present invention aims to solve the above-mentioned problem by providing a heat shielding structure which ensures a reliable connection in an assembly for connecting a spark plug to an ignition cable.

To this end, a heat shielding structure for internal-combustion engines includes a cylinder block. The heat shielding structure connects an ignition cable having a cable end to a spark plug.

The heat shielding structure includes a spark plug having a stud terminal extending from the cylinder block; a plug boot including a cylinder-side end portion and a cable-side end portion, the plug boot containing a high-voltage terminal held under pressure between the cable end and the stud terminal, so that the ignition cable and the spark plug are maintained in a connected state.

A heat shield has a substantially cylindrical form and includes a cylinder-side end portion and a cable-side end portion, the heat shield covering the plug boot. An auxiliary heat shield includes a cylinder-side end portion and a cable-side end portion and covers the heat shield with a predetermined space therebetween.

A lid unit has a pressing portion which contacts the cable-side end portion of the plug boot, the ignition cable extending from the cable-side end portion of the plug boot through a cable hole, whereby the cylinder-side end portion of the auxiliary heat shield is fixed between the spark plug and the cylinder block, and the lid unit forms a locking arrangement together with the cable-side end portion of the auxiliary heat shield, and whereby, when the lid unit is fitted to the cable-side end portion of the auxiliary heat shield, the pressing portion exerts a downward force on the plug boot through the locking arrangement.

In the above heat shielding assembly, the lid unit may include a barrel portion adapted for fitting onto the cable-side end portion of the auxiliary heat shield, and the locking arrangement includes a pair of recesses formed at the cable-side end portion of the auxiliary heat shield, at substantially diametrically distal positions thereof and in the tangential direction thereof.

A pair of notches is formed in the barrel portion of the lid unit, at positions corresponding to those of the pair of recesses when the lid unit is fitted, the pair of notches including an opening. A U-shaped retaining member includes a pair of grip portions, wherein the U-shaped retaining member is fitted laterally into the notches, so that the pair of grip portions are exposed from the openings of the notches and wherein the lid unit is fitted onto the cable-side end portion of the auxiliary heat shield, so that the pair of grip portions is fitted into the pair of recesses.

Alternatively, the lid unit may comprise a male portion which fits into the cable-side end portion of the auxiliary heat shield, and the locking arrangement may include a pair of notches formed in the cable-side end portion of the auxiliary heat shield, at substantially diametrically distal positions thereof and in the tangential direction thereof. The pair of notches include openings.

A pair of recesses are formed in the male portion of the lid unit at positions corresponding to those of the pair of notches when the lid unit is fitted, and a U-shaped retaining member includes a pair of grip portions, wherein the U-shaped retaining member is fitted laterally into the notches, so that the pair of grip portions are exposed from the openings of the notches and wherein the lid unit is fitted onto the cable-side end portion of the auxiliary heat shield, so that the pair of grip portions is fitted into the pair of recesses Furthermore, the lid unit may include a male portion which fits into the cable-side end portion of the auxiliary heat shield and the locking arrangement may include a plurality of shield ears protruding radially inwardly from the cable-side end portion of the auxiliary heat shield, the shield ears having first fixing members. A plurality of lid ears protrude radially outwardly from the pressing portion of the lid unit, the lid ears including second fixing members, wherein the lid unit is fitted into the cable-side end portion of the auxiliary heat shield while pressing down the plug boot by the pressing portion of the lid unit, such that the lid ears do not abut against the shield ears. The lid unit is rotated, whereby the first fixing members are fitted with the second fixing members.

Preferably, the shield ears each include an abutting member in a corresponding position thereof in the circumferential direction of the auxiliary heat shield, such that the lid ears abut against the abutting members at positions where the first fixing members and the second fixing members are to be fitted.

In yet another variant of the invention, the locking arrangement may include a pair of flanges arranged at substantially diametrically distal positions of the auxiliary heat shield. A pair of strips include a hook portion, a finger portion and a link portion serving as a fulcrum therefor, the pair of strips being arranged at positions corresponding to those of the pair of flanges when the lid unit is fitted, the pair of strips being tied to the lid unit through the link portion, such that the pair of strips can move in opposite directions and can exert elastically restoring forces, wherein the pair of strips are fitted to the pair of flanges under the elastically restoring forces and the pair of strips are released from the pair of flanges by flexing the finger portions against the elastically restoring forces.

Furthermore, the lid unit may include a male portion which fits into said cable-side end portion of the auxiliary heat shield and the locking arrangement may include a plurality of contact sections which contact the auxiliary heat shield when the lid unit is fitted, the contact sections including first fixing members. A plurality of recessed sections are arranged so as to alternate with the contact sections, the recessed sections not contacting the auxiliary heat shield. Second fixing members are provided in the cable-side end portion of the auxiliary heat shield, the second fixing members being arranged at the positions corresponding to those of the first fixing members when the lid unit is fitted, wherein the male portion is fitted into the auxiliary heat shield, such that the second fixing members are led through the recessed sections, and the lid unit is rotated, so that the first fixing members and the second fixing members are fitted.

In the heat shielding assembly of the invention, the cable-side end portion of the heat shield may be flared so as to contact the lid unit, whereby the heat shield is grounded through the lid unit and the auxiliary heat shield.

The lid unit may include a barrel portion which fits onto the cable-side end portion of the auxiliary heat shield. The barrel portion includes a circular bottom rim, a plurality of slits extending outwardly therefrom and an inner circular face. The locking arrangement may include a flared portion provided in the cable-side top portion of the heat shield; first fixing members provided in the cable-side top portion of the auxiliary heat shield; a plurality of slats formed in the barrel portion and defined by the plurality of slits; and second fixing members provided on the plurality of slats, wherein, when the lid unit is mounted onto the cable-side end portion of the auxiliary heat shield, the flared portion of the heat shield abuts against the inner circular face of barrel portion, and the first fixing members fit with the second fixing members.

The present invention further provides a heat shielding structure for internal-combustion engines including a cylinder block, the heat shielding structure connecting an ignition cable having a cable end to a spark plug and including a spark plug including a stud terminal extending from the cylinder block. A plug boot includes a cylinder-side end portion and a cable-side end portion, the plug boot containing a high-voltage terminal held under pressure between the cable end and the stud terminal, so that the ignition cable and the spark plug are maintained in a connected state.

A heat shield has a substantially cylindrical form and includes a cylinder-side end portion and a cable-side end portion, the heat shield covering the plug boot. An auxiliary heat shield includes a cylinder-side end portion and a cable-side end portion and covers the heat shield with a predetermined space therebetween.

A lid unit includes a pressing portion which contacts the cable-side end portion of plug boot and an ignition cable extending through a cable hole from the cable-side end portion of the plug boot, whereby the cylinder-side end portion of the heat shield is fixed between the spark plug and the cylinder block and the lid unit forms a locking arrangement together with the cable-side end portion of the auxiliary heat shield, whereby, when the lid unit is fitted to the cable-side end portion of the auxiliary heat shield, the pressing portion exerts downward forces on the plug boot through the locking arrangement, and wherein the heat shield and the auxiliary heat shield are integrally formed through each of the cable-side end portions thereof.

Preferably, the lid unit is provided with air-ventilation holes. Also, the cylinder-side end portion of at least the auxiliary heat shield and the heat shield is provided with water drainage holes.

BRIEF DESCRIPTION OF THE DRAWINGS

The above and other objects, features and advantages of the present invention will be made apparent from the following description of the preferred embodiments, given as non-limiting examples, with reference to the accompanying drawings, in which.

DETAILED DESCRIPTION OF THE PREFERRED EMBODIMENTS

A heat shielding structure in a connector assembly connecting a spark plug to an ignition cable according to a first embodiment of the invention will now be described.

Figure 5:
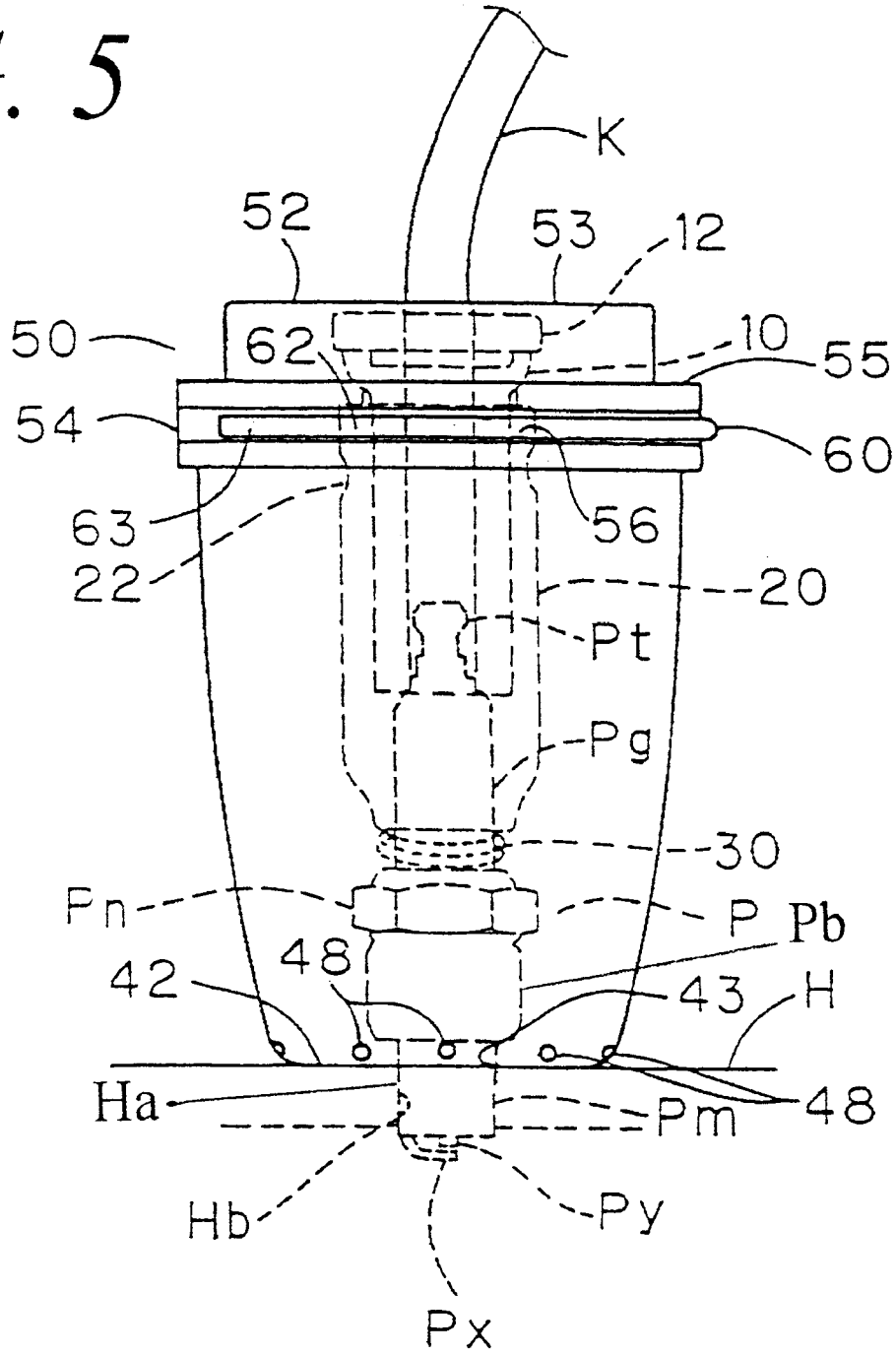
FIG. 5 is a side view of a heat shielding structure of spark plug and an ignition cable according to a first embodiment of the invention.
Figure 6:
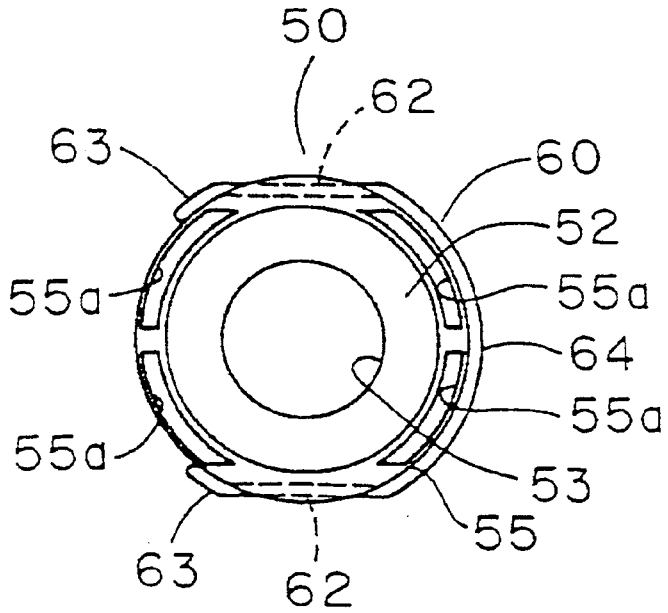
FIG. 6 is a plan view of the heat shielding structure of FIG. 5.

As shown in FIGS. 5 and 6, the heat shielding structure of the invention includes a spark plug P mounted on cylinder block H; a plug boot 10 for connecting an ignition cable K to a spark plug, the end portion of the cable being provided with a high-voltage terminal (not shown in the figures); a heat shield 20 covering the outer surface of the plug boot 10; an auxiliary heat shield 40 covering the heat shield 20; and a lid unit 50 provided at the top-end portion (seen in FIG. 5) of auxiliary heat-shield 40.

The spark plug P is of standard configuration. It has a nut-shaped head Pn approximately halfway along its principal axis. The bottom end of the spark plug (i.e. the end proximal to the engine cylinder block) is provided with a shank Pb and a threaded foot Pm. The threaded foot Pm is fitted into a threaded bore Ha within the engine cylinder head H, so that the spark plug P is fixed to engine cylinder block H with its stud terminal Pt directed upwardly.

Beneath threaded foot Pm are provided a grounding electrode Px and a center electrode Py. The grounding electrode Px electrically contacts the engine cylinder block H through the threaded foot Pm and shank Pb. In this manner, the entire internal-combustion engine is grounded. The other end of spark plug P, relative to nut-shaped head Pn includes a substantially cylindrical insulator Pg on the upper end of which is mounted stud terminal Pt. The center electrode Py is electrically connected inside the spark plug P to the stud terminal Pt.

The plug boot 10 is made of an elastic material such as rubber, and has a substantially cylindrical shape. It is provided with a circular rib 12 which projects diametrically outwardly from the circular upper-end of plug boot 10. A plurality of lugs run down from beneath the circular rib 12 toward the engine side on the outer surface of spark plug P and along its axial direction (cf. FIG. 2). The plug boot 10 contains a high-voltage terminal and ignition cable K. The high-voltage terminal is pressed onto the end portion of the ignition cable. The stud terminal Pt and insulator PO projecting from engine cylinder block H are frictionally inserted into plug boot 10 from its underside and held therein by gripping forces, such that the high-voltage terminal and stud terminal Pt are caused to be securely in contact. A high voltage can then be applied to the center electrode Py through ignition cable K, the high-voltage terminal, and stud terminal Pt.

The heat shield 20 is made of a light metal such as aluminum and is formed into a substantially cylindrical shape. The inner diameter of the heat shield is slightly larger than the outer diameter of plug boot 10. The top-side zone (cable-side end portion) of heat shield 20 is provided with a circular recess 22, and the bottom-side zone (cylinder-side end portion) is tapered towards the engine. When the plug boot 10 is pressed into the heat shield 20 from above, the circular surface of plug boot 10 adjacent to circular rib 12 closely contacts the circular recess 22. The heat shield 20 thus covers and is fixed upon plug boot 10.

Figure 3:
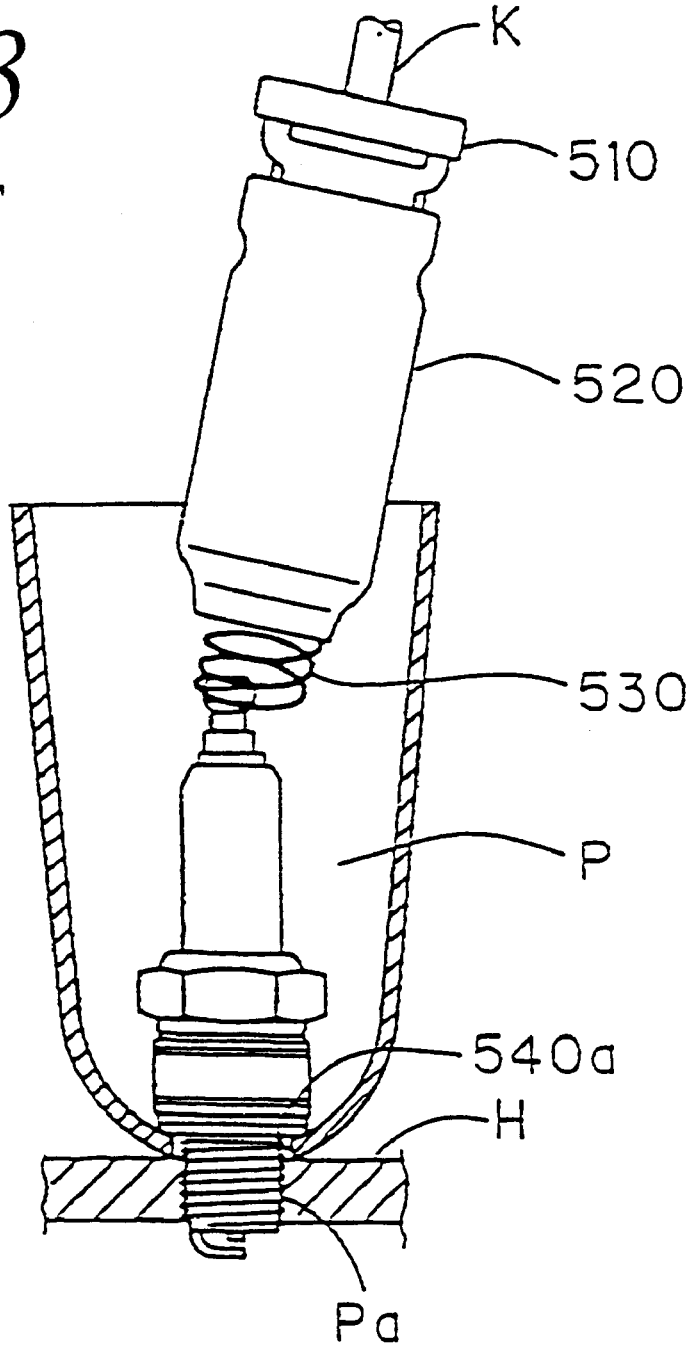
FIG. 3 PRIOR ART
FIG. 3 is a side view of a partially exploded prior art heat shield assembly when it is being assembled.
Figure 4:
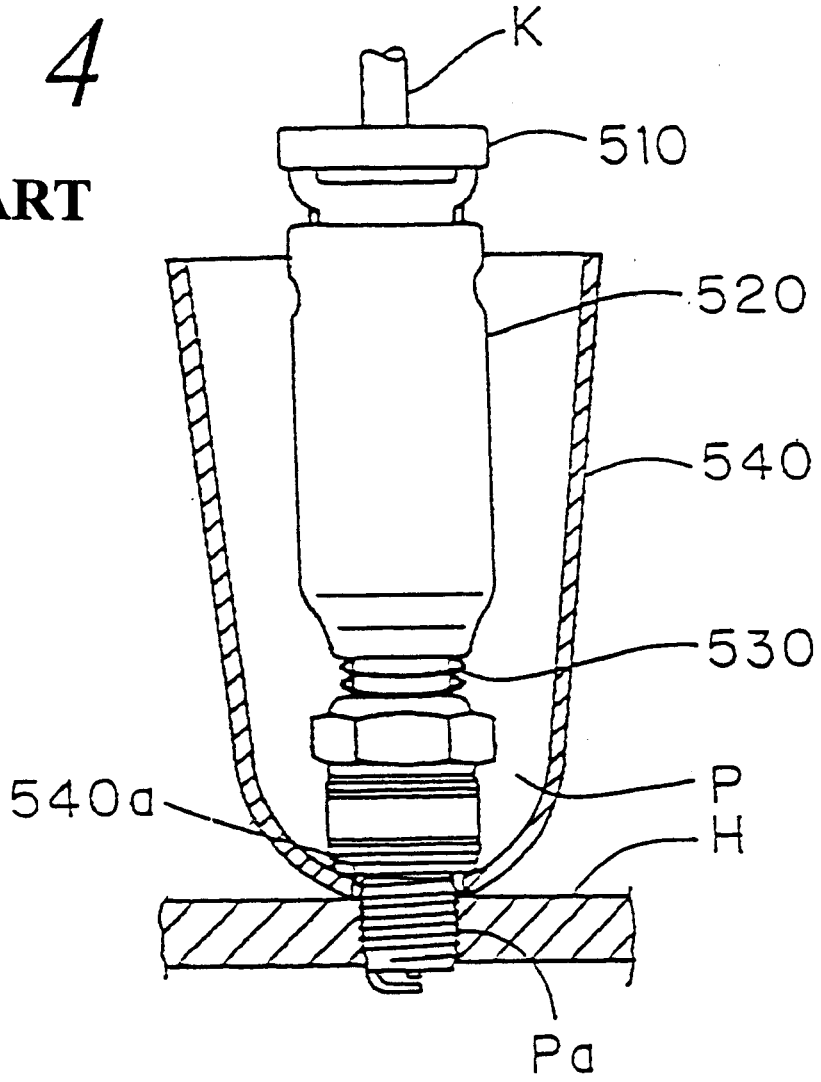
FIG. 4 PRIOR ART
FIG. 4 is a side and partially exploded view of the heat shield assembly of FIG. 3, when almost completely assembled.

The bottom-side portion of heat shield 20 is provided with a spring 30 which extends from within the heat shield 20 to the engine (cf. FIGS. 3 and 4). When the heat shield 20 is installed onto the stud terminal Pt, the bottom-side portion of the spring 30 abuts against the nut-shaped head Pn, whereby the heat shield is grounded via spring 30.

The auxiliary heat shield 40 is made of a light metal such as aluminum and is formed into a substantially cylindrical shape which tapers towards the engine. The auxiliary heat shield 40 also includes a base 42 at its tapered end. The base 42 has a shield hole 43 for the passage of the threaded foot Pm. When the auxiliary heat shield 40 covers the spark plug P, the threaded foot Pm passes through the shield hole 43. The threaded foot Pm is then fitted into an internally threaded bore Ha. Thus, the rim zone of the shield hole 43 of base 42 is gripped between the surface portion of cylinder block H surrounding the internally threaded bore Ha and the shank Pb. Accordingly, the auxiliary heat shield 40 covers heat shield 20 with a predetermined gap with respect to the latter and is fixed in this state.

The portion of the base 42 of auxiliary heat shield 40 surrounding the shield hole 43 is provided with a plurality of water drainage holes 48.

Figure 7:
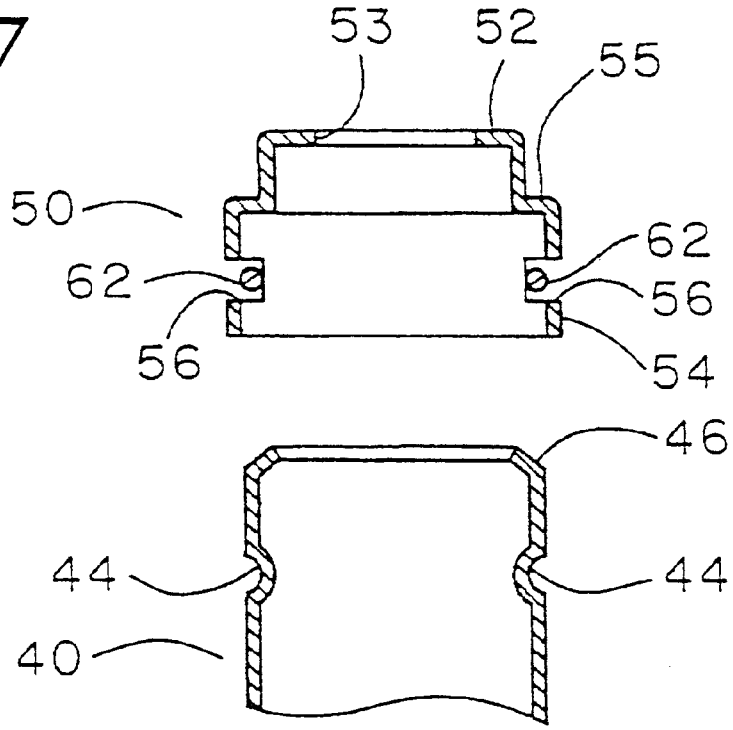
FIG. 7 is an axially cross-sectional and partially exploded view of a top end of the heat shielding structure of FIG. 5.

The upper portion of auxiliary heat shield 40 is provided with a pair of diametrically opposed recesses 44 which project perpendicularly to the mounting direction of the plug boot 10 (FIG. 7). A retaining member 60 having a pair of grip portions 62 (FIG. 6) is fitted over the recesses 44, such that each pair of grip portions is elastically clasped with the corresponding pair of recesses 44.

Furthermore, as shown in FIG. 7, the auxiliary heat shield 40 has a tapered upper end portion 46. This portion serves as a guide for facilitating fitting when the lid unit 50 (described later) is mounted onto the top-end portion of auxiliary heat shield 40.

The upper end of the lid unit 50 includes a pressing portion 52 and a barrel portion 54 which extends downwardly from the pressing portion and is fitted onto the top-end portion of auxiliary heat shield 40.

The barrel portion 54 is slightly larger than the external diameter of the top-end portion of the auxiliary heat shield 40. Barrel portion 54 includes a pair of diametrically opposed elongate notches 56, which correspond to recesses 44, and which extend perpendicularly to the mounting direction of the plug boot 10.

When the lid unit 50 is inserted on the top-end portion of the auxiliary heat shield 40, the barrel portion 54 fits snugly over the outside of the top-end portion of the auxiliary heat shield 40. In this state, recesses 44 and notches 56 are mutually aligned.

The pressing portion 52 has an outer diameter smaller than that of the top-end portion of auxiliary heat shield 40. It is continuous from the upper end of barrel portion 54 through the circular step 55. The center zone of the pressing portion 52 is provided with a cable hole 53, through which the ignition cable K extending from the upper portion (cable-side end portion) of plug boot 10 extends. When the lid unit 50 is mounted onto the top-end portion of the auxiliary heat shield 40, and while ignition cable K passes through cable hole 53, the lower section of pressing portion 52 and the upper end surface of plug boot 10 are in contact.

The circular step 55 is provided with four arcuate ventilation holes 55*a* arranged around its circumference.

After the lid unit 50 is mounted onto the top-end portion of auxiliary heat shield 40, the retaining member 60 is laterally inserted. Alternatively, the retaining member 60 may be first inserted together with lid unit 50, the two subsequently being fitted onto the auxiliary heat shield 40.

The retaining member 60 is U-shaped and includes a pair of substantially parallel grip portions 62 and a web portion 64 connecting the grip portions.

The separation between the two grip portions 62 is about the same as that between recesses 44. The tip of each of grip portion 62 is slightly bent inwardly so as to form a slide stopper 63. The web portion 64 is arcuate to conform to the shape of the barrel portion 54.

The grip portions 62 of retaining member 60 are slid laterally to the position where recesses 44 and notches 56 are aligned and are elastically fitted. The lid unit 50 is then mounted onto the top-end portion of the auxiliary heat shield 40, so that retaining member 60 engages the barrel portion 54. Lid unit 50 is thus mounted to the top-end portion of the auxiliary heat shield 40 and prevented from falling from the heat shield.

The heat shielding assembly is constructed as follows. The spark plug P is first inserted in the auxiliary heat shield 40. The threaded foot Pm, which projects downwardly from auxiliary heat shield 40, is then passed through the shield hole 43 and fitted with internally threaded hole Ha.

The ignition cable K is initially passed through cable hole 53 of lid unit 50, with its end portion pressed onto a high-voltage terminal. The high-voltage terminal is then pressed into the plug boot 10, and the latter is fitted with insulator Pg of spark plug P, so that the ignition cable K and stud terminal Pt are electrically connected.

Subsequently, lid unit 50 is laterally fitted with retaining member 60, and lid unit 50 is fitted onto the upper opening of auxiliary heat shield 40, such that both notches 56 of the lid unit 50 are aligned with the corresponding recesses 44 of the auxiliary heat shield 40.

In this way, the pressing portion 52 of lid unit 50 presses down the plug boot 10. Lid unit 50 is thus easily and reliably mounted on the top-end potion of auxiliary heat shield 40, without risk of falling off.

It is noted that with this heat shielding structure covering the connector assembly between spark plug P and ignition cable K, the base portion 42 of the auxiliary heat shield 40 is held between the spark plug P and the cylinder block H. Furthermore, the lid unit 50 is firmly mounted on the top-end portion of auxiliary heat shield 40. This structure causes the pressing portion 52 of lid unit 50 to drive the plug boot 10 downwardly, whereby the top-end portion of plug boot 10 is also held by lid unit 50 via auxiliary heat shield 40. By virtue of this configuration, and by contrast with known structures, vibrations of the internal-combustion engine no longer cause plug boot 10 to disengage from spark plug P. The connection between ignition cable K and spark plug P is thus more reliably established.

Further, since the circular step 55 is provided with four arcuate air ventilation holes 55*a* along the circumferential direction, any air between auxiliary heat shield 40 and heat shield 20 can pass through these holes and thereby discharge heat from the heat shielding structure very efficiently. The air-ventilation holes 55*a* may have a round, oval, elongate, strip shape, or any other appropriate shape.

The base portion 42 of auxiliary heat shield 40 is provided with water drainage holes 48. When water floods the heat shielding structure and permeates the auxiliary heat shield 40, it is drained out through these water drainage holes 48. This structure confers good water drainage to the heat shielding structure. The water drainage holes 48 may have a round, elliptical, elongate, strip shape, or any other appropriate shape.

A second embodiment of the invention, relating to the heat shielding structure covering the connector assembly between spark plug P and ignition cable K, is described hereafter. For conciseness, only the differences with respect to the first embodiment of the invention shall be detailed.

Figure 8:
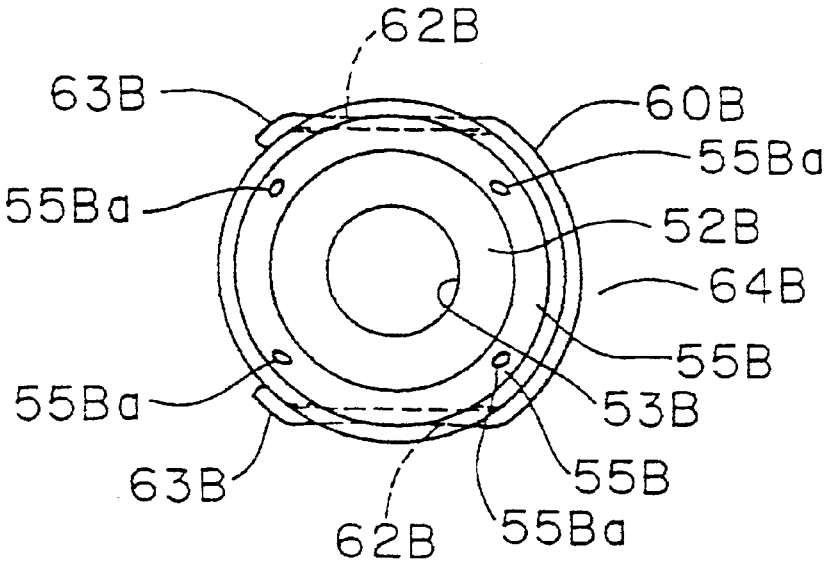
FIG. 8 is a plan view of the heat shielding structure according to a second embodiment of the invention.
Figure 9:
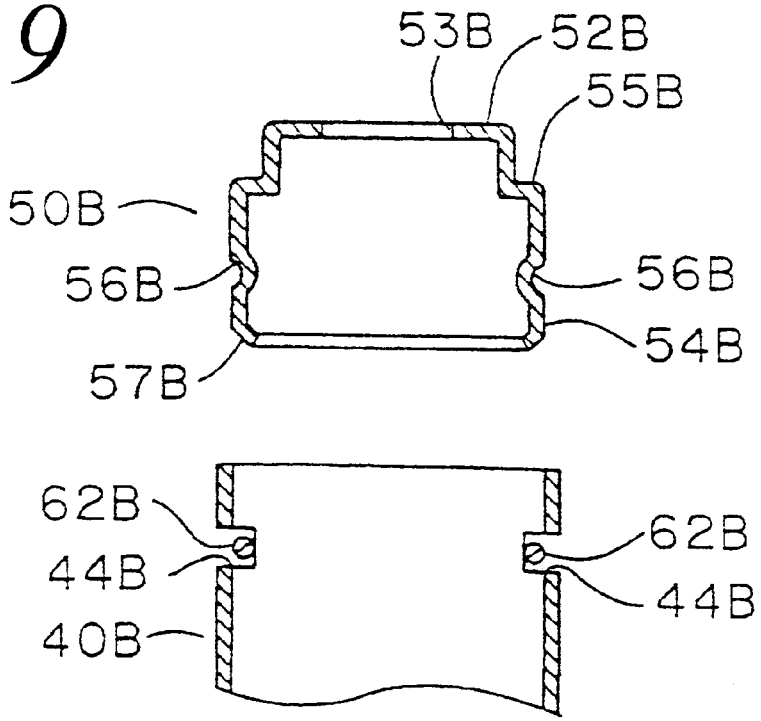
FIG. 9 is an axially cross-sectional view of a partially exploded top end of the heat shielding structure of FIG. 8.

In the second embodiment shown in FIGS. 8 and 9, the lid unit 50B is fitted inside the upper-end portion of auxiliary heat shield 40B.

The top-end portion of heat shield 40B is provided with a pair of diametrically opposed notches 44B which extend perpendicularly from the mounting direction of the plug boot 10.

Lid unit 50B has a male portion 54B which frictionally engages the inner surface of the top-end portion of auxiliary heat shield 40B. The male portion 54B is provided with a pair of diametrically opposed recesses 56B, i.e. at positions corresponding to those of notches 44B, which project perpendicularly to the mounting direction of the plug boot 10. After male portion 54B is frictionally engaged into the top-end portion of auxiliary heat shield 40B, its position is adjusted by rotating lid unit 50B, so that notches 44B and recesses 56B are mutually aligned.

The circular bottom rim of male portion 54B is gradually tapered downwardly so as to form tapered rim portion 57B. This serves as a guide when fitting lid unit 50B into the top-end portion of auxiliary heat shield 40 and facilitates fitting.

Further, the top-end portion of the male portion 54B is provided with pressing portion 52B via a circular step 55B. The outer diameter of this step is smaller than that of male portion 54B. The center zone of pressing portion 52B is provided with a cable hole 53B, through which ignition cable K is drawn out from the top of plug boot 10.

The circular step 55B is provided with four elliptical air-ventilation holes 55B*a* which are uniformly distributed around the circumferential direction.

The retaining member 60B is U-shaped and is formed by a pair of parallel grip portions 62B linked via a web portion 64B, so that the grip portions 62B can be elastically opened outwardly.

The separation between the two grip portions 62B is about the same as that between recesses 56B, and the edges of grip portions 62B are slightly bent inwardly, so as to form slide-stop portion 63B. Furthermore, the web 64B is arcuate to correspond with the outer shape of male portion 54B.

In this case, the top-end portion of auxiliary heat shield 40B is first laterally fitted with retaining member 60B. The lid unit 50B is then fitted into this top end portion, such that the grip portions 62B, which are exposed from the bottom of the notches 44B of auxiliary heat shield 40B, are fitted within the corresponding recesses 56B of lid 50B. Lid unit 50B is thus prevented from falling off the top-end portion of auxiliary heat shield 40B. In this state, the bottom end face of pressing portion 52B is in contact with the top end face of the plug boot 10, and drives the plug boot 10 downwardly, just as in the first embodiment.

According to the heat shielding structure of the second embodiment, the connection between ignition cable K and spark plug P is also reliably established, and the heat shielding structure thus prepared gives good performance for evacuating heat and draining water.

As retaining member 60B is laterally fitted on the top end portion of auxiliary heat shield 40B, and recesses 54B and notches 44B are mutually aligned, fitting of lid 50B unit onto auxiliary heat shield 40B is very easy and reliable. Moreover, lid unit 50B is held without the risk of slipping off.

According to a third embodiment of the invention, the heat shielding structure covering the connector assembly between spark plug P and ignition cable K differs from the first embodiment in several points described hereinafter.

Figure 10:
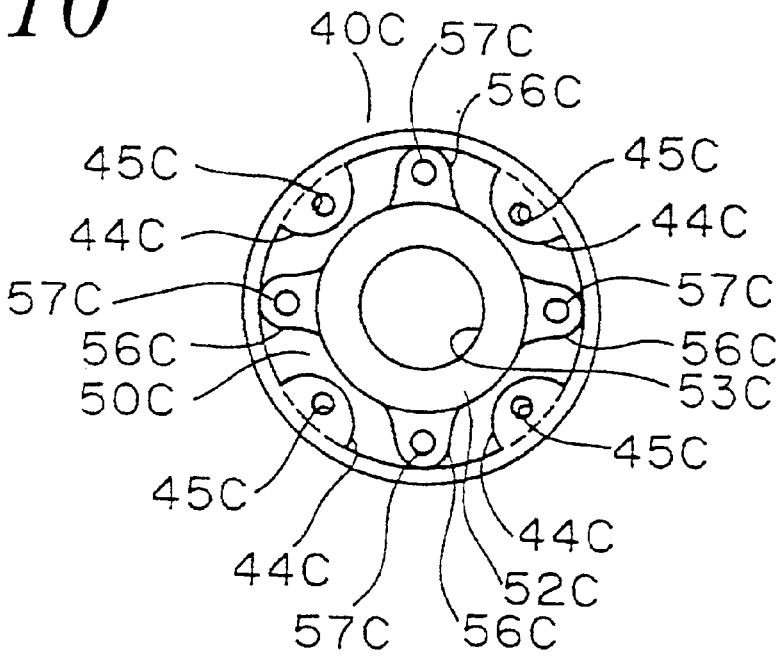
FIG. 10 is a plan view of the heat shielding structure according to a third embodiment of the invention.
Figure 11:
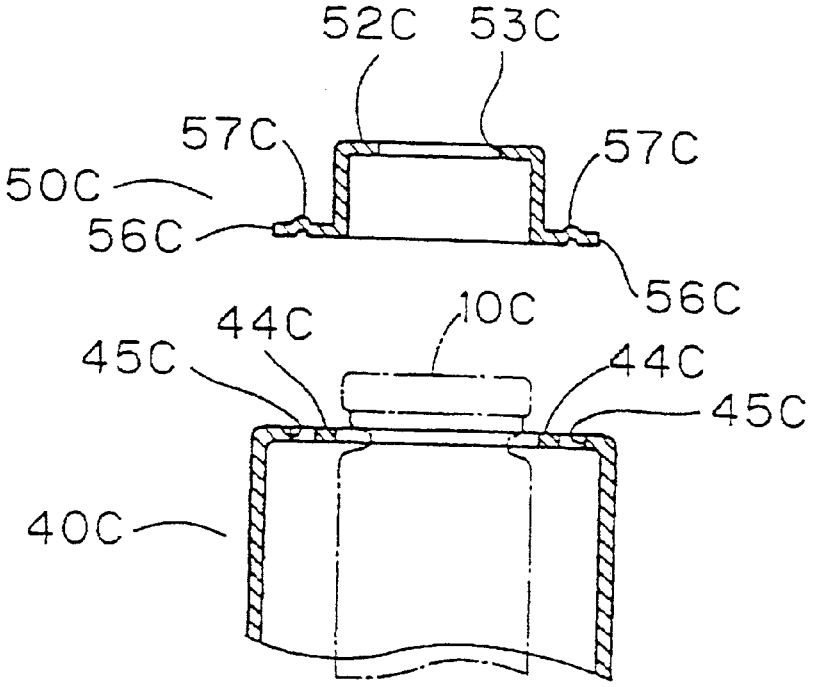
FIG. 11 is an axially cross-sectional and partially exploded view of a top end of the heat shielding structure of FIG. 10.

As shown in FIGS. 10 and 11, the top-end peripheral portion of auxiliary heat shield 40C is provided with four shield ears 44C, while the peripheral portion of lid unit 50C includes four lid ears 56C. The lid unit 50C is fixed on the top-end portion of auxiliary heat shield 40C through shield ears 44C and lid ears 56C.

In this embodiment, four shield ears 44C are formed and uniformly distributed in the top-end peripheral portion of auxiliary heat shield 40C in the circumferential direction. The four shield ears 44C extend radially inwardly in the horizontal plane. Each shield ear 44C has a shield ear hole 45C, with which a lid ear stopper 57C (described later) is fitted.

The lid unit 50C is formed into a substantially cylindrical shape, in which the top-end portion is enclosed by a pressing portion 52C. The pressing portion 52C has a diameter that allows it to pass in the space formed by the four shield ears 44C.

The bottom-end peripheral portion of lid 50C is provided with four corresponding lid ears 56C which are uniformly distributed in the circumferential direction. The four lid ears 56C extend diametrically outwardly in the horizontal plane. Each lid ear 56C has a lid ear stopper 57C which projects upwardly and can be fitted into shield ear hole 45C.

The center zone of the pressing portion 52C is provided with a cable passage hole 53C. When lid unit 50C is fitted onto the top-end portion of auxiliary heat shield 40C, the ignition cable K extends from the top of plug boot 10C (shown in dotted lines in FIG. 11), and is drawn out through cable hole 53C.

The heat shielding structure is constructed as follows. Lid unit 50C is placed on the top-end portion of plug boot 10C, with each lid ear 56C positioned between two shield ears 44C, so as not to be superposed on shield ears 44C when fitting. Subsequently, the plug boot 10C is pushed downwardly by pressing on pressing portion 52C of lid unit 50C. Then the lid unit 50C is rotated around the axis thereof, after which the lid ears 56C slide towards the underneath of shield ear holes 45C, and the lid ear stoppers 57C are fitted into corresponding shield ear holes 45C. As the pressing portion 52C drives plug boot 10C downwardly, the lid 50C is firmly fitted on the auxiliary heat shield 40C.

According to this heat shielding structure, the lid unit 50C is mounted onto the top-end portion of auxiliary heat shield 40C, while the pressing portion 52C drives plug boot 10C downwardly. The lid unit 50C is therefore prevented from sliding away from the top-end portion of auxiliary heat shield 40C. By virtue of this configuration, even when the internal-combustion engine causes vibrations, the plug boot 10C cannot be removed from spark plug P, so that the ignition cable K and spark plug P are securely connected.

This result is achieved simply by placing the lid unit 50C onto the top-end portion of plug boot 10C and pushing downwardly. Thereafter, lid unit 50C is rotated, in order to fit lid ear stoppers 57C into shield ear holes 45C. The assembly is thus very easy.

A fourth embodiment of the invention is described hereinafter with reference to the third embodiment.

Figure 12:
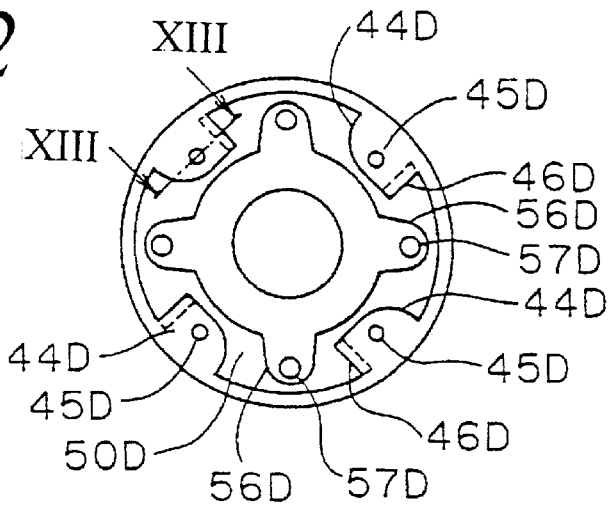
FIG. 12 is a plan view of the heat shielding structure according to a fourth embodiment of the invention.
Figure 13:
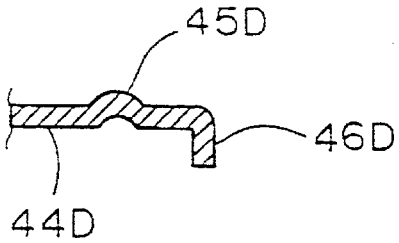
FIG. 13 is a cross-sectional view taken along lines XIII—XIII of FIG. 12.
Figure 14:
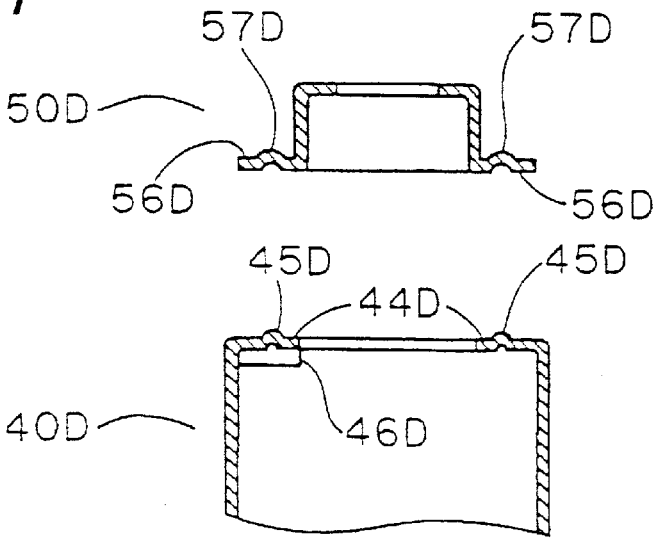
FIG. 14 is an axially cross-sectional and partially exploded view of a top end of the heat shielding structure of FIG. 12.

As shown in FIGS. 12 to 14, abutting ribs 46D are arranged, facing downwardly, at the same side of each of the shield ears 44D, as viewed in the circumferential direction. The center zone of each shield ear 44D is stamped to form a recess 45D facing downwardly. Lid unit 50D has the same construction as lid unit 50C of the third embodiment.

As shown in FIG. 12, lid unit 50D is pushed into auxiliary heat shield 40D from the top, and rotated clockwise in the circumferential direction, so that lid ear stoppers 57D on lid ears 56D fit with corresponding shield ear recesses 45D of shield ears 44D. During rotation, one side of shield ears 44D comes into abutment against the rib 46D, and the clockwise movement of lid 50D is stopped. The other elements in the fourth embodiment are the same as in the third embodiment.

The heat shielding structure according to the fourth embodiment yields the same effect as in the third embodiment. In addition, after the lid unit 50D is mounted on the top-end portion of auxiliary heat shield 40D, clockwise rotation of lid 50D is prevented. If there was no abutting rib 46D, the lid ear stoppers 57D may be removed from the shield ear recesses 45D when engine vibrations cause a clockwise movement of lid 50D. The construction according to the fourth embodiment prevents this kind of incident, so that lid 50D can be more securely mounted on auxiliary heat shield 40D.

The heat shielding structure according to a fifth embodiment is described hereinafter, with reference to the first embodiment.

Figure 15:
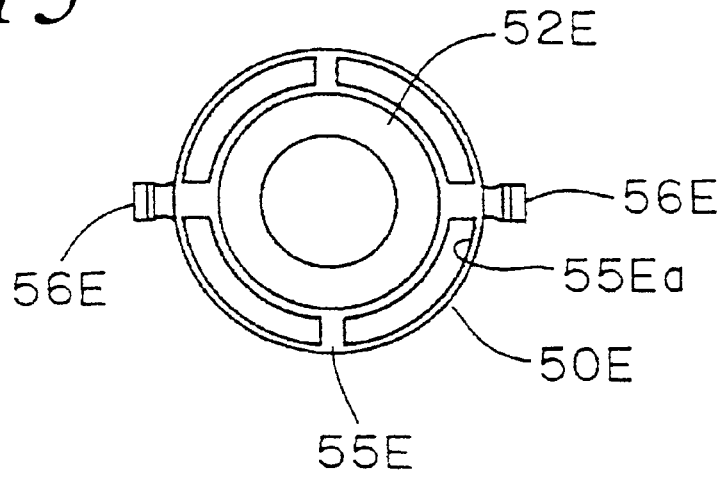
FIG. 15 is a plan view of the heat shielding structure according to a fifth embodiment of the invention.
Figure 16:
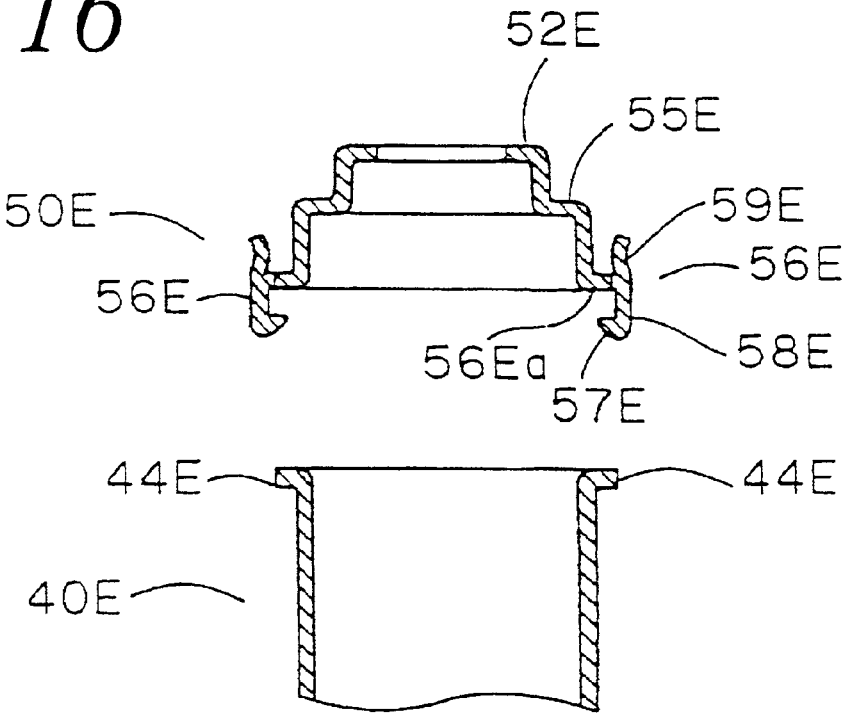
FIG. 16 is an axially cross-sectional and partially exploded view of a top end of the heat shielding structure of FIG. 15.

As shown in FIGS. 15 and 16, the auxiliary heat shield 40E is provided with a pair of flanges 44E, which are placed at diametrically opposed positions on the auxiliary heat shield 40E. The bottom-end peripheral portion of lid unit 50E includes a pair of diametrically opposed strips 56E around the lid 50E.

Strip 56E includes a hook portion 58E, a finger portion 59E and a link portion 56E*a* serving as a fulcrum. The link portion 56E*a* is attached to the lid unit 50E by welding or any other equivalent means, is moveable in opposite directions, and exerts elastically restoring forces.

The bottom-end, inner circular face of hook portion 58E extends inwardly, so as to form a claw portion 57E, the lower face of which is tapered upwardly towards the tip of claw portion 57E.

The pair of flanges 44E protrudes diametrically outwardly at the top-end peripheral portion of auxiliary heat shield 40E.

When lid unit 50E is pushed against auxiliary heat shield 40E, the tapered face of each claw portion 57E contacts a corresponding flange 44E, and hook portion 58E is outwardly moved. After claw portion 57E has overridden flange 44E, hook portion 58E is restored back, and claw portion 57E fits underneath flange 44E. Lid unit 50E is thus firmly mounted on the top-end of auxiliary heat shield 40E. In this state, the pressing portion 52E of lid unit 50E contacts the top-end face of plug boot 10, and drives it downwardly.

When lid unit 50E is removed from the top end of the auxiliary heat shield 40E, both finger portions 59E of strips 56E are flexed diametrically inwardly, and the hook portion 58E is moved against restoring forces. Hook portion 58E is released from flange 44E, so that lid unit 50E can be removed from auxiliary heat shield 40E by a simple raising action.

The circular step 55E of lid unit 50E is provided with four arcuate air-ventilation holes 55E*a* along the circumferential direction of lid unit 50E.

According to the fifth embodiment, lid unit 50E is mounted on the top-end portion of auxiliary heat shield 40E, such that the pressing portion 52E of lid unit 50E drives the plug boot 10 downwardly. Therefore, even when the internal-combustion engine vibrates, the plug boot 10 does not fall off spark plug P. The ignition cable K is thus securely connected to spark plug P.

The air-ventilation holes 55E*a* serve to evacuate the air inside auxiliary heat shield 40E. The structure according to the fifth embodiment thus has a good heat-discharging capacity as in the preceding embodiments.

Furthermore, hook portions 58E are fitted with corresponding flanges 44E, so that lid unit 50E is firmly fixed on the top end of auxiliary heat shield 40E. Moreover, capping of lid unit 50E is easily handled. Also, hook portions 58E are easily released from flanges 44E, simply by flexing finger portions 59E inwardly. The lid unit 50E is thus easily removed from auxiliary heat shield 40E. Accordingly, maintenance work on the connector assembly between spark plug P and ignition cable K is easily carried out.

The sixth embodiment of the present invention is described hereinafter, with reference to the first embodiment.

Figure 17:
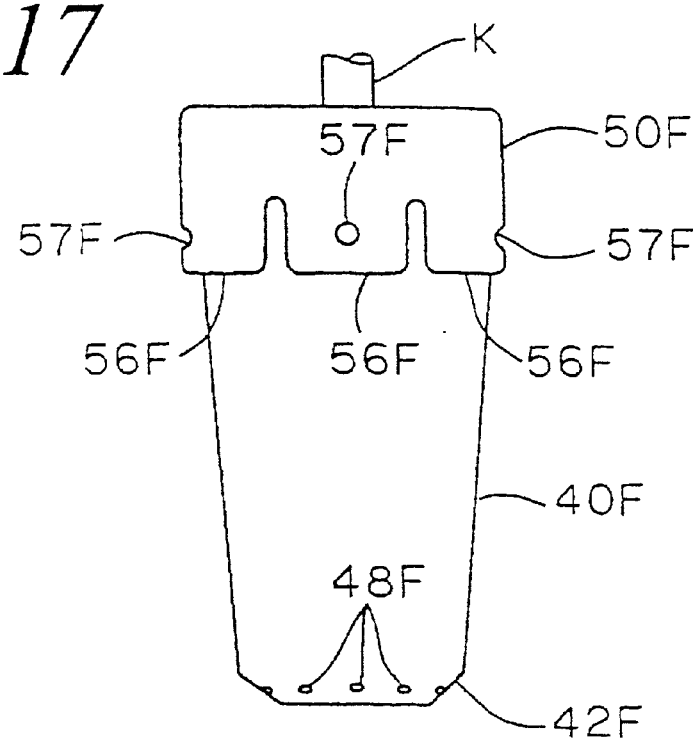
FIG. 17 is a side view of the heat shielding structure according to a sixth embodiment of the invention.
Figure 18:
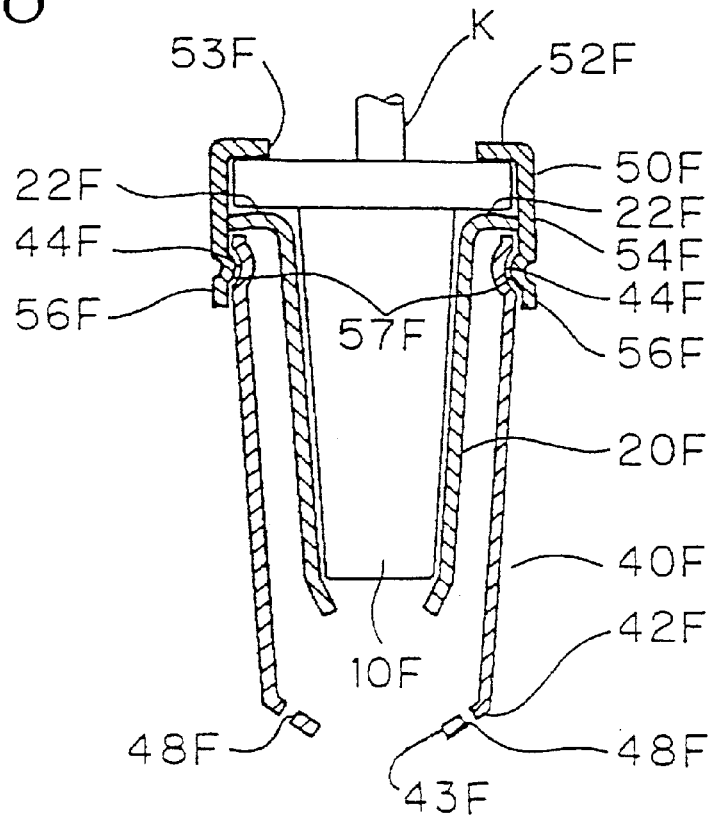
FIG. 18 is an axially cross-sectional and partially transparent view of a heat shielding structure of FIG. 17.

As shown in FIGS. 17 and 18, the top-end portion of heat shield 20F is flared in a funnel-like shape, and the flared portion 22F comes into contact with lid unit 50F.

The top-end peripheral portion of auxiliary heat shield 40F is provided with four outwardly facing recesses 44F, which are distributed uniformly around the circumferential direction.

Lid unit 50F includes a pressing portion 52F and a cable hole 53F in the central zone thereof. The whole structure may be made of an elastic material such as a metal, and formed into a substantially cylindrical shape. The cylindrical wall 54F thereof includes a circular bottom rim, from which vertical slits 56F*a* are formed to extend about half way in the upward direction, at four positions in the circumferential direction. Vertical slits 56F*a* define four elastic slats 56F. Each elastic slat 56F is provided with an inwardly projecting stopper 57F, which engages a corresponding recess 44F of the auxiliary heat shield 40F.

The pressing portion 52F is fitted with plug boot 10F, such that it closes the cable hole 53F in cooperation with the top end of plug boot 10F. When the lid unit 50F is mounted onto the top-end portion of auxiliary heat shield 40F, the ignition cable K, which extends from the upper end of plug boot 10F, passes through cable hole 53F.

The heat shield 20F has a flared top portion 22F. When the lid unit 50F is mounted onto the top-end portion of auxiliary heat shield 40F, the inner circular face of cylindrical wall 54F of lid unit 50F is placed into contact with the edge rim of flared top portion 22F.

Also, the bottom portion 42F of the auxiliary heat shield 40F includes a bottom hole 43F and a plurality of round water drainage holes 48F disposed around the bottom hole 43F.

To assemble the heat shield, the spark plug P is installed on cylinder block H, and auxiliary heat shield 40F is fixed onto spark plug P. Then, the plug boot 10F which is surrounded by heat shield 20F is fixed to the spark plug P. The lid unit 50F is then fitted onto the top-end portion of auxiliary heat shield 40F, such that the inwardly projecting stoppers 57F of lid unit 50F and the recesses 44F of auxiliary heat shield 40F are arranged on substantially the same level in the vertical direction. The inwardly projecting stoppers 57F are then received by corresponding recesses 44F, while flexing elastic slats 56F outwardly. In this manner, the lid unit 50F is fixed onto the top-end portion of the auxiliary heat shield 40F without risk of falling off. At the same time, the bottom-end face of pressing portion 52F abuts against the top-end face of plug boot 10F, so that plug boot 10F is fixed under downward driving forces.

Furthermore, the edge rim of the flared top portion 22F, formed on the top-end portion of heat shield 20F, contacts the inner circular face of cylindrical wall 54F of lid unit 50F.

According to the sixth embodiment described above, the top end of plug boot 10F is fixed through the auxiliary heat shield 40F, under the downward driving forces exerted by lid unit 50F. Therefore, even if vibrations occur in the internal-combustion engine, plug boot 10F is not removed from the spark plug P. Reliability of the connection between ignition cable K and spark plug P is thus improved.

The lid unit 50F is forcibly fitted onto the top-end portion of auxiliary heat shield 40F, so that it is prevented from slipping off. Moreover, lid unit 50F can be easily mounted on auxiliary heat shield 40F.

When water permeates into auxiliary heat shield 40F, it can be drained out through water drainage holes 48F.

Figure 1:
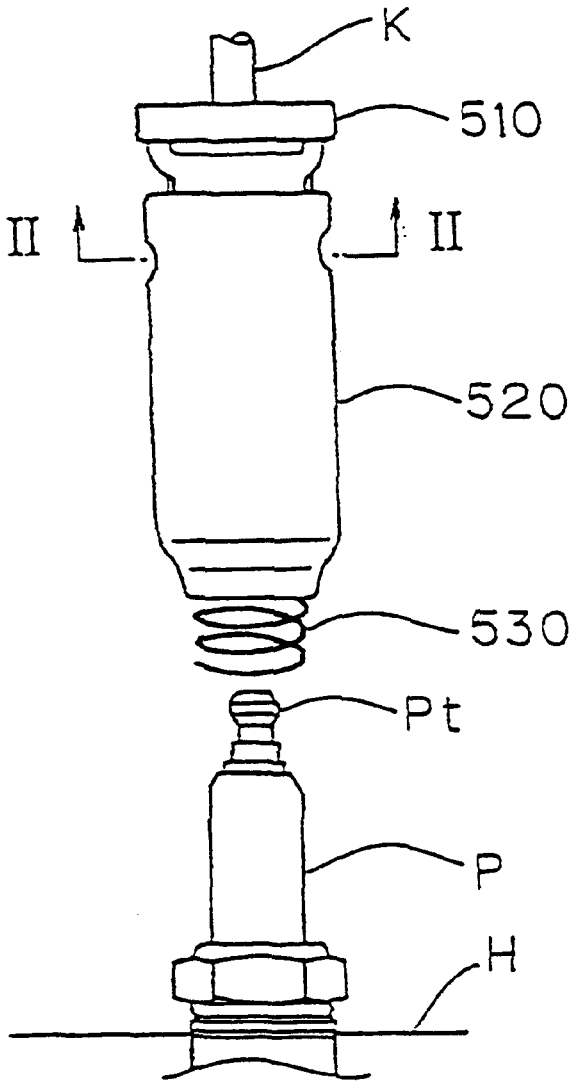
FIG. 1 PRIOR ART
FIG. 1 is an exploded side view of a prior art heat shield assembly mounted in an engine cylinder block.
Figure 2:
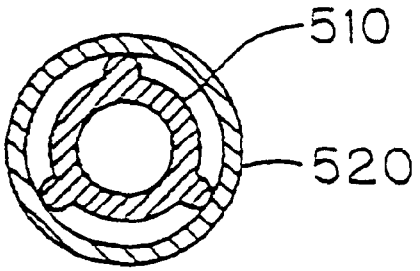
FIG. 2 PRIOR ART
FIG. 2 is a cross-sectional view taken along lines II—II of FIG. 1.

In order to ground the heat shield, a spring 530 such as shown in FIGS. 1 to 3 was used in the past. In this case, when fitting plug boot 10F to stud terminal Pt of spark plug P, the spring 530 interfered with stud terminal Pt, so that the insertion of stud terminal Pt into spring 530 was not easy, or bad connections were formed by an improper fitting.

In the present embodiment, the flared top portion 22F of the heat shield 20F contacts lid unit 50F, so that the grounding of heat shield 20F is effected through flared top portion 22F, lid unit 50F and auxiliary heat shield 40F. Therefore, the spring 530, previously used for grounding the heat shield, can be eliminated. This arrangement further improves insertion or fitting, when fitting plug boot 10F to the stud terminal Pt of spark plug P.

The configuration according to the sixth embodiment can also be applied to the preceding embodiments 1 to 5.

The invention according to a seventh embodiment is described hereinafter, with reference to the sixth embodiment.

Figure 19:
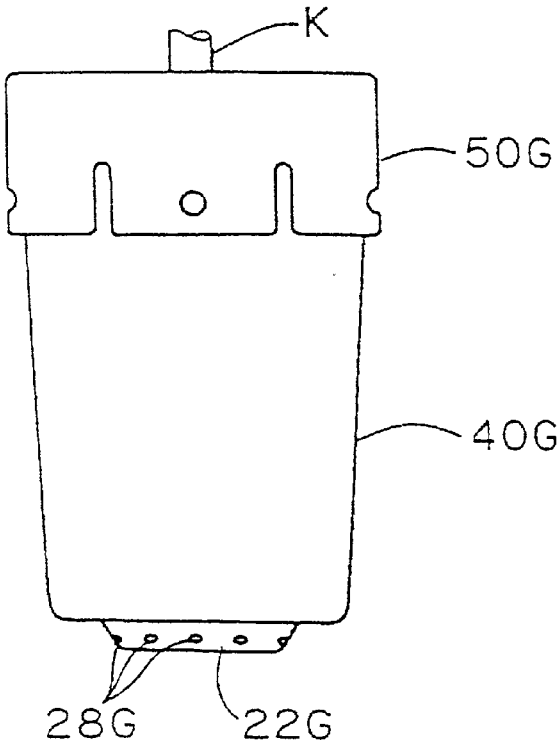
FIG. 19 is a side view of the heat shielding structure according to a seventh embodiment of the invention.
Figure 20:
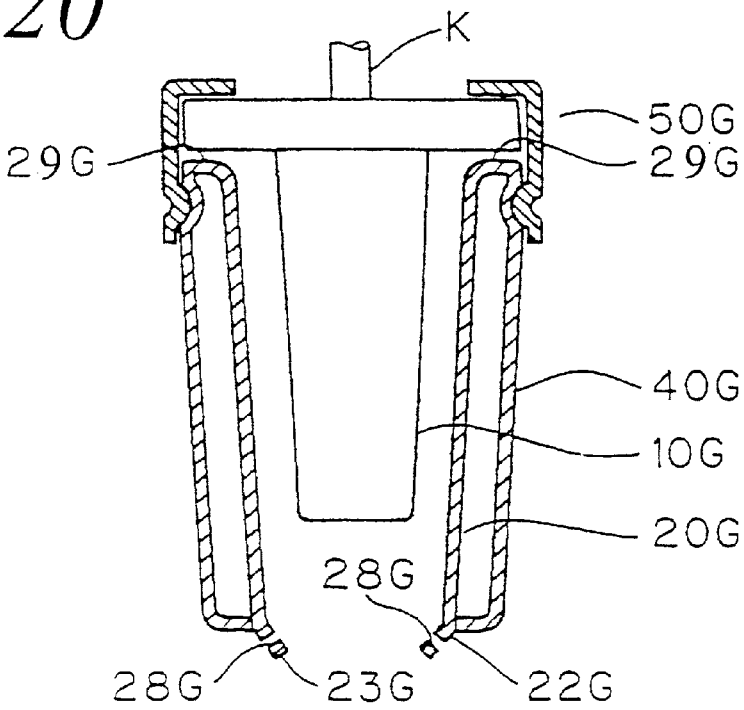
FIG. 20 is an axially cross-sectional view of a heat shielding structure of FIG. 19.
Figure 21:
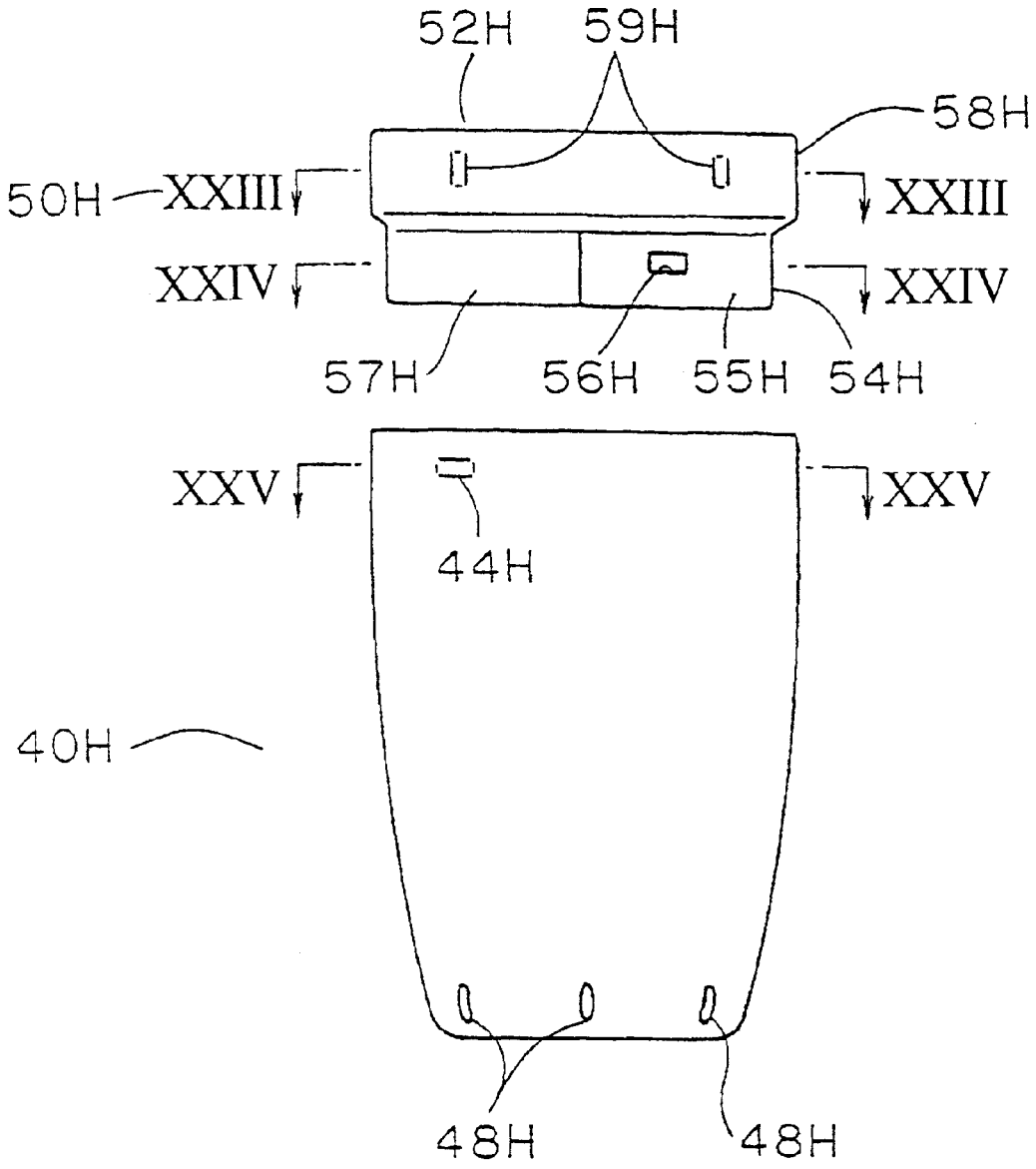
FIG. 21 is an exploded side view of the heat shielding structure according to an eighth embodiment of the invention.
Figure 22:
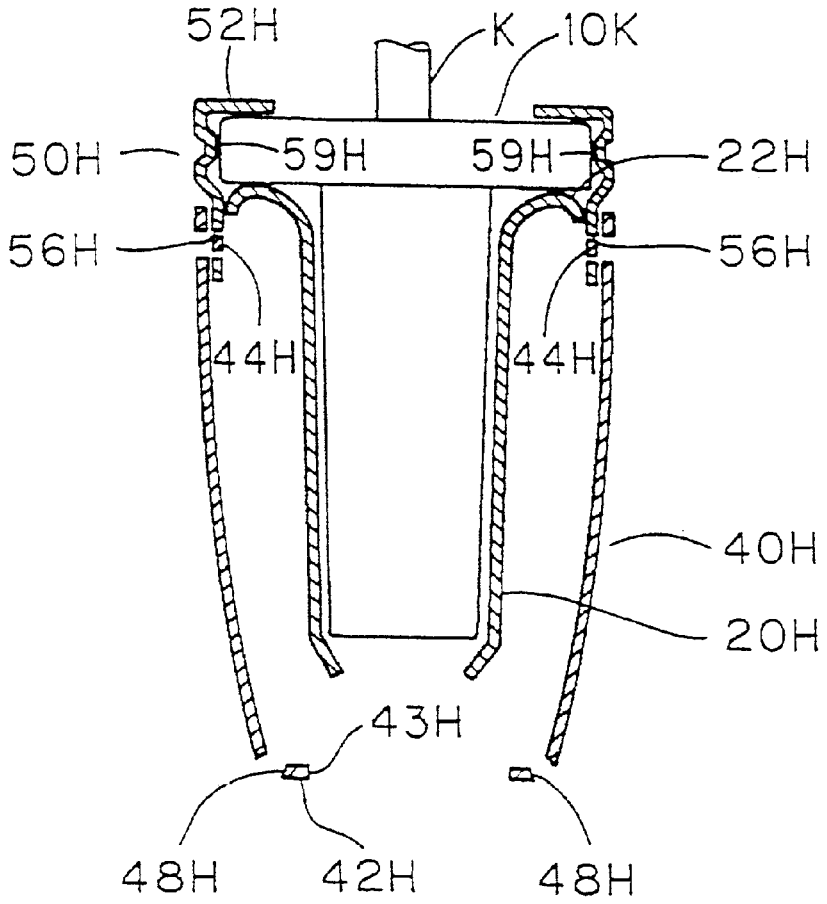
FIG. 22 is an axially cross-sectional view of the heat shielding structure of FIG. 21.
Figure 23:
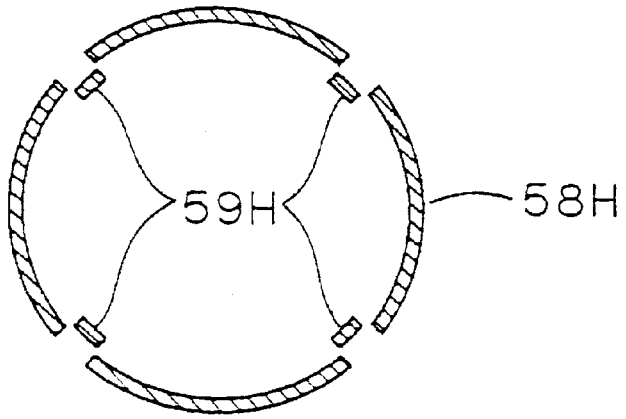
FIG. 23 is a cross-sectional view taken along lines XXIII—XXIII of FIG. 21.

As shown in FIGS. 19 and 20, the top-end portion of auxiliary heat shield 40G and that of heat shield 20G are integrally formed through link portion 29G.

Furthermore, the bottom-end portion of heat shield 20G includes an inwardly tapered base 22G. The center portion of the inwardly tapered base 22G has a base hole 23G, through which threaded portion Pa of spark plug P is passed. While the threaded portion Pa is passed through the base hole 23G, the spark plug P is fixed to cylinder block H. As a result, heat shield 20G is firmly fixed by holding it between cylinder block H and spark plug P.

The bottom-end peripheral portion of the auxiliary heat shield 40G is bent towards the bottom-end outer peripheral face of heat shield 20G, so that auxiliary heat shield 40G and heat shield 20G form a nearly closed space.

The inwardly tapered base 22G of heat shield 20G is provided with a plurality of round water drainage holes 28G around base hole 23G.

The lid unit 50G is fitted on the top-end portion of auxiliary heat shield 40G as in the case of the sixth embodiment.

According to the seventh embodiment, the lid unit 50G holds down the top-end portion of plug boot 10G with a downward driving force, so that spark plug P and ignition cable K are securely connected.

When water occasionally penetrates heat shield 20G, it will be drained out through water drainage holes 28G of base 22G, thereby ensuring a good waterproofing of the heat shield 20G.

As the heat shield 20G and auxiliary heat shield 40G are integrally formed through link portion 29G, the heat shield 20G is grounded through base portion 22G. At the same time, auxiliary heat shield 40G is grounded through link portion 29G and heat shield 20G. Accordingly, spring 530, previously used for grounding the heat shield, can be omitted. By so obviating the need for the spring 530, insufficient fitting, which can occur when engaging plug boot 10G with stud terminal Pt of spark plug P, can be avoided.

The invention according to the seventh embodiment can also be applied in the preceding embodiments 1 to 5.

The eighth embodiment of the invention is shown in FIGS. 21 to 25, with reference to the sixth embodiment.

Figure 25:
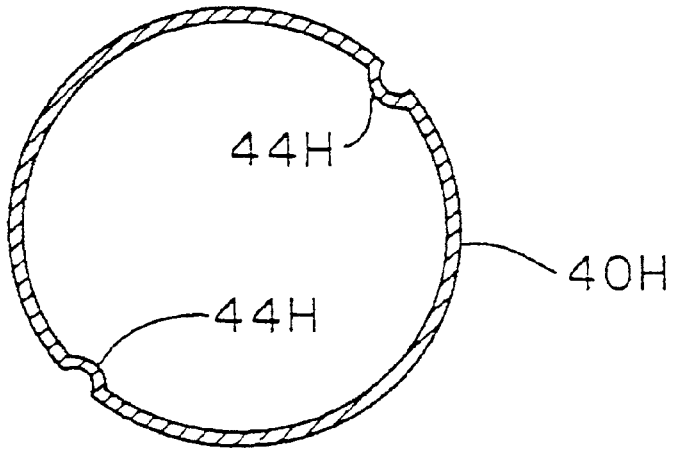
FIG. 25 is a cross-sectional view taken along lines XXV—XXV of FIG. 21.

As in the preceding heat shielding structure, the structure according to the eighth embodiment includes auxiliary heat shield 40H and the cylindrical wall at the top-end portion thereof. The diametrically opposed portions of the cylindrical wall are notched, so as to form a pair of horizontally parallel cut-outs. The strip between the pair of cut-outs is indented radially inwardly, so as to form a recess 44H (FIG. 25).

The lid unit 50H is made of an elastic material, and includes a male portion 54H which is inserted inside the top-end portion of auxiliary heat shield 40H, an upper barrel portion 58H having a diameter slightly larger than that of male portion 54H, and a pressing portion 52H provided at the upper side of upper barrel portion 58H.

Figure 24:
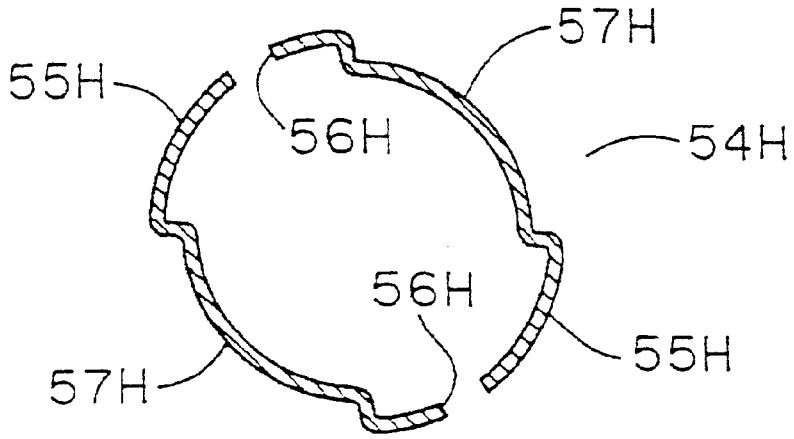
FIG. 24 is a cross-sectional view taken along lines XXIV—XXIV of FIG. 21.

As shown in FIG. 24, the male portion 54H includes a pair of contact sections 55H forming a divided cylindrical shape, which fits to the inside surface of the top-end portion of auxiliary heat shield 40H, and recessed sections 57H, which are located between contact sections 55H and are radially inwardly recessed relative to contact sections 55H.

Each contact section 55H includes a stopper hole 56H which receives a corresponding stopper 44H. The lid unit 50H is mounted onto the top-end portion of auxiliary heat shield 40H, such that stopper 44H is positioned into recessed section 57H. Male portion 54H is then fitted into the top-end peripheral portion of auxiliary heat shield 40H, until it reaches barrel portion 58H. Subsequently, lid 50H is rotated until each stopper 44H fits into corresponding stopper hole 56H.

The barrel portion 58H is provided with four protrusions 59H which are equally spaced in the circumferential direction of barrel portion 58H. Each protrusion 59H is defined by a pair of vertically extending cut-outs, and formed by inwardly recessing the elongate portion flanked by the pair of cut-outs. When lid unit 50H is mounted on auxiliary heat shield 40H by fitting stopper 44H into stopper hole 56H, each protrusion 59H abuts against circular rib 12 of plug boot 10, while the inner face of pressing portion 52H abuts against the upper face of circular rib 12. The lid 50H exerts a downward driving force, so that plug boot 10 is firmly held at a predetermined position.

The top-end portion of heat shield 20H is flared along the upward direction so as to form a flared top portion 22H. When the lid unit 50H is mounted on auxiliary heat shield 40H, the rim edge of the flared top portion 22H comes into contact with the inner surface of male portion 54H of lid unit 50H.

The base portion 42H of heat shield 20H is provided with a plurality of oval-shaped water drainage holes 48H around the base hole 43H.

According to the eighth embodiment, the plug boot 10 is firmly held by the downward driving forces exerted by lid unit 50H, such that, even if the internal-combustion engine vibrates, the plug boot 10 is not removed from the spark plug P. The connection between the ignition cable K and the spark plug P is thus reliably established.

When water seeps into the auxiliary heat shield 40H, it can be evacuated through water drainage holes 48H, thereby securing good waterproofing of the heat shielding structure.

Furthermore, mounting the lid unit 50H on auxiliary heat shield 40H only requires fitting the latter into the top-end portion of auxiliary heat shield 40H, and rotating the lid unit 50H. Fitting of lid unit 50H is thus very easy.

Also, the heat shield 20H is grounded through the top flared portion 22H, lid unit 50H and auxiliary heat shield 40H, so that the commonly used grounding spring 530 can be eliminated. As a result, fitting of plug boot 10 into stud terminal Pt of spark plug P is facilitated, and improper fitting is prevented.

In all the above-mentioned embodiments, the space contained between heat shield 20 (20B to 20H) and auxiliary heat shield 40 (40B to 40H) may be ventilated. To this end, lid 50 unit (50B to 50H) is preferably provided with air-ventilation holes. Heat discharge from the heat shielding structure is thus more efficiently carried out. In the seventh embodiment in particular, the link portion 29G is preferably provided together with air-ventilation holes 55E*a*.

Furthermore, the space between heat shield 20 (20B to 20H) and auxiliary heat shield 40 (40B to 40H) may be filled with inorganic fillers, or interposed with heat-resistant films.

Although the invention has been described with reference to particular means, materials, and embodiments, it is to be understood that the invention is not limited to the particulars disclosed and extends to all equivalents within the scope of the claims.

The present disclosure relates to subject-matter contained in priority Japanese Application No. HEI-10-66975, filed on Mar. 17, 1998, which is herein expressly incorporated by reference in its entirety.

What is claimed:

1. A heat shielding structure for internal-combustion engines including a cylinder block, said heat shielding structure connecting an ignition cable having a cable end to a spark plug, said heat shielding structure comprising:

a spark plug including a stud terminal extending from said cylinder block;

a plug boot including a cylinder-side end portion and a cable-side end portion, said plug boot containing a high-voltage terminal held by pressure between said cable end and said stud terminal, so that said ignition cable and said spark plug are maintained in a connected state;

a heat shield having a substantially cylindrical shape and including a cylinder-side end portion and a cable-side end portion, said heat shield covering said plug boot;

an auxiliary heat shield including a cylinder-side end portion and a cable-side end portion, and covering said heat shield with a predetermined space therebetween; and a lid unit including a pressing portion which contacts said cable-side end portion of said plug boot and a cable hole from which said ignition cable extends from said cable-side end portion of said plug boot;

whereby said cylinder-side end portion of said auxiliary heat shield is fixed between said spark plug and said cylinder block and said lid unit forms a locking arrangement together with said cable-side end portion of said auxiliary heat shield, whereby, when said lid unit is fitted to said cable-side end portion of said auxiliary heat shield, said pressing portion exerts a downward force on said plug boot through said locking arrangement.

2. The heat shielding structure according to claim 1, wherein said lid unit comprises a barrel portion which fits onto said cable-side end portion of said auxiliary heat shield and said locking arrangement comprises:

a pair of recesses formed in said cable-side end portion of said auxiliary heat shield, at substantially diametrically distal positions thereof and in the tangential direction thereof;

a pair of notches formed in said barrel portion of said lid unit, at positions corresponding to those of said pair of recesses when said lid unit is fitted, said pair of notches including an opening; and a U-shaped retaining member including a pair of grip portions;

wherein said U-shaped retaining member is fitted laterally into said notches, so that said pair of grip portions is exposed from said opening of said notches and wherein said lid unit is fitted onto said cable-side end portion of said auxiliary heat shield, so that said pair of grip portions is fitted into said pair of recesses.

3. The heat shielding structure according to claim 2, wherein said cable-side end portion of said heat shield is flared so as to be placed into contact with said lid unit, whereby said heat shield is grounded through said lid unit and said auxiliary heat shield.

4. The heat shielding structure according to claim 1, wherein said lid unit comprises a male portion which fits into said cable-side end portion of said auxiliary heat shield and said locking arrangement comprises:

a pair of notches formed in said cable-side end portion of said auxiliary heat shield, at substantially diametrically distal positions thereof and in the tangential direction thereof, said pair of notches including an opening;

a pair of recesses formed in said male portion of said lid unit, at positions corresponding to those of said pair of notches when said lid unit is fitted; and a U-shaped retaining member including a pair of grip portions;

wherein said U-shaped retaining member is fitted laterally into said notches, so that said pair of grip portions is exposed from said openings of said notches and wherein said lid unit is fitted onto said cable-side end portion of said auxiliary heat shield, so that said pair of grip portions is fitted into said pair of recesses.

5. The heat shielding structure according to claim 4, wherein said cable-side end portion of said heat shield is flared so as to be placed into contact with said lid unit, whereby said heat shield is grounded through said lid unit and said auxiliary heat shield.

6. The heat shielding structure according to claim 1, wherein said lid unit comprises a male portion which fits into said cable-side end portion of said auxiliary heat shield and said locking arrangement comprises:

a plurality of shield ears protruding radially inwardly from said cable-side end portion of said auxiliary heat shield, said plurality of shield ears including first fixing members;

a plurality of lid ears protruding radially outwardly from said pressing portion of said lid unit, said lid ears including second fixing members;

wherein said lid unit is fitted into said cable-side end portion of said auxiliary heat shield while pressing down said plug boot by said pressing portion of said lid unit, such that said lid ears do not abut against said shield ears, and said lid unit is rotated, whereby said first fixing members are fitted with said second fixing members.

7. The heat shielding structure according to claim 6, wherein said cable-side end portion of said heat shield is flared so as to be placed into contact with said lid unit, whereby said heat shield is grounded through said lid unit and said auxiliary heat shield.

8. The heat shielding structure according to claim 6, wherein said shield ears each comprise an abutting member in a corresponding position thereof in a circumferential direction of said auxiliary heat shield, such that said lid ears abut against said abutting members at positions where said first fixing members and said second fixing members are to be fitted.

9. The heat shielding structure according to claim 8, wherein said cable-side end portion of said heat shield is flared so as to be placed into contact with said lid unit, whereby said heat shield is grounded through said lid unit and said auxiliary heat shield.

10. The heat shielding structure according to claim 1, wherein said locking arrangement comprises:

a pair of flanges arranged at substantially diametrically distal positions of said auxiliary heat shield;

a pair of strips including a hook portion, a finger portion and a link portion serving as a fulcrum therefor, said pair of strips being arranged at positions corresponding to those of said pair of flanges when said lid unit is fitted, said pair of strips being connected to said lid unit through said link portion, such that said pair of strips can move in opposite directions and exert elastically restoring forces, wherein said pair of strips is fitted to said pair of flanges under said elastically restoring forces and said pair of strips is released from said pair of flanges by flexing said finger portions against said elastically restoring forces.

11. The heat shielding structure according to claim 10, wherein said cable-side end portion of said heat shield is flared so as to be placed into contact with said lid unit, whereby said heat shield is grounded through said lid unit and said auxiliary heat shield.

12. The heat shielding structure according to claim 1, wherein said lid unit comprises a barrel portion which fits onto said cable-side end portion of said auxiliary heat shield, said barrel portion including a circular bottom rim, a plurality of slits extending onwardly therefrom, and an inner circular face, and said locking arrangement comprises:

a flared portion provided in said cable-side top portion of said heat shield;

first fixing members provided in said cable-side top portion of said auxiliary heat shield;

a plurality of slats, formed in said barrel portion and defined by said plurality of slits; and second fixing members provided on said plurality of slats;

wherein, when said lid unit is mounted onto said cable-side end portion of said auxiliary heat shield, said flared portion of said heat shield abuts against said inner circular face of barrel portion, and said first fixing members fit with said second fixing members.

13. The heat shielding structure according to claim 12, wherein said cable-side end portion of said heat shield is flared so as to be placed into contact with said lid unit, whereby said heat shield is grounded through said lid unit and said auxiliary heat shield.

14. The heat shielding structure according to claim 1, wherein said lid unit comprises a male portion which fits into said cable-side end portion of said auxiliary heat shield and said locking arrangement comprises:

a plurality of contact sections which contact said auxiliary heat shield when said lid unit is fitted, said contact sections including first fixing members;

a plurality of recessed sections arranged so as to alternate with said contact sections, said recessed sections not being in contact with said auxiliary heat shield; and second fixing members provided in said cable-side end portion of said auxiliary heat shield, said second fixing members being arranged at the positions corresponding to those of said first fixing members when said lid unit is fitted;

wherein said male portion is fitted into said auxiliary heat shield, such that said second fixing members are led through said recessed sections, and said lid unit is rotated, so that said first fixing members and said second fixing members are fitted together.

15. The heat shielding structure according to claim 14, wherein said cable-side end portion of said heat shield is flared so as to be placed into contact with said lid unit, whereby said heat shield is grounded through said lid unit and said auxiliary heat shield.

16. The heat shielding structure according to claim 1, wherein said cable-side end portion of said heat shield is flared so as to be placed into contact with said lid unit, whereby said heat shield is grounded through said lid unit and said auxiliary heat shield.

17. The heat shielding structure according to claim 1, wherein said lid unit is provided with air-ventilation holes.

18. The heat shielding structure according to claim 1, wherein said cylinder-side end portion of at least one of said auxiliary heat shield and said heat shield is provided with water drainage holes.

19. A heat shielding structure for internal-combustion engines including a cylinder block, said heat shielding structure connecting an ignition cable having a cable end to a spark plug, said heat shielding structure comprising:

a spark plug including a stud terminal extending from said cylinder block;

a plug boot including a cylinder-side end portion and a cable-side end portion, said plug boot containing a high-voltage terminal held under pressure between said cable end and said stud terminal, so that said ignition cable and said spark plug are maintained in a connected state;

a heat shield having a substantially cylindrical form and including a cylinder-side end portion and a cable-side end portion, said heat shield covering said plug boot;

an auxiliary heat shield including a cylinder-side end portion and a cable-side end portion, and covering said heat shield with a predetermined space therebetween; and a lid unit including a pressing portion which contacts said cable-side end portion of said plug boot and a cable hole from which said ignition cable extends from said cable-side end portion of said plug boot;

whereby said cylinder-side end portion of said heat shield is fixed between said spark plug and said cylinder block and said lid unit forms a locking arrangement together with said cable-side end portion of said auxiliary heat shield, whereby, when said lid unit is fitted to said cable-side end portion of said auxiliary heat shield, said pressing portion exerts a downward force on said plug boot through said locking arrangement, and wherein said heat shield and said auxiliary heat shield are integrally formed through each of said cable-side end portions thereof.

20. The heat shielding structure according to claim 19, wherein said cable-side end portion of said heat shield is flared so as to be placed into contact with said lid unit, whereby said heat shield is grounded through said lid unit and said auxiliary heat shield.

* * * * *